US005163196A

United States Patent [19]

Graebe et al.

[11] Patent Number: 5,163,196

[45] Date of Patent: Nov. 17, 1992

[54] ZONED CELLULAR CUSHION WITH FLEXIBLE FLAPS CONTAINING INFLATING MANIFOLD

[75] Inventors: Robert H. Graebe; Winfield R. Matsler, both of St. Clair County, Ill.

[73] Assignee: Roho, Inc., Belleville, Ill.

[21] Appl. No.: 778,450

[22] Filed: Oct. 16, 1991

Related U.S. Application Data

[63] Continuation-in-part of Ser. No. 607,902, Nov. 1, 1990, abandoned.

[51] Int. Cl.[5] ..... A61G 9/00

[52] U.S. Cl. ..... 5/654; 5/464; 5/455; 5/464; 5/455

[58] Field of Search ..... 5/455, 456, 464, 449, 5/654, 652

[56] References Cited

U.S. PATENT DOCUMENTS 2,731,652 1/1956 Bishop ..... 5/455
3,984,886 10/1976 Keeton ..... 5/455
4,267,611 5/1981 Agulnick ..... 5/455

FOREIGN PATENT DOCUMENTS 1951476 10/1969 Fed. Rep. of Germany .

*Primary Examiner*—Renee S. Luebke
*Assistant Examiner*—F. Saether
*Attorney, Agent, or Firm*—Polster, Lieder, Woodruff & Lucchesi

[57] ABSTRACT

An inflatable cushion is organized into zones or compartments which are normally isolated from each other. The base of the cushion contains channels which lead from the several zones to a flap-type valve. When the flag is extended, the channels are connected through a manifold in the valve. However, when the flap is folded over upon itself, the channels are blocked before the manifold and the zones are isolated. Having separate and isolated zones, the cushion provides improved stability and better serves to maintain the user in a desired posture. A modification has individual fill valves and stems for each zone and for the manifold.

16 Claims, 4 Drawing Sheets

FIG. 1.
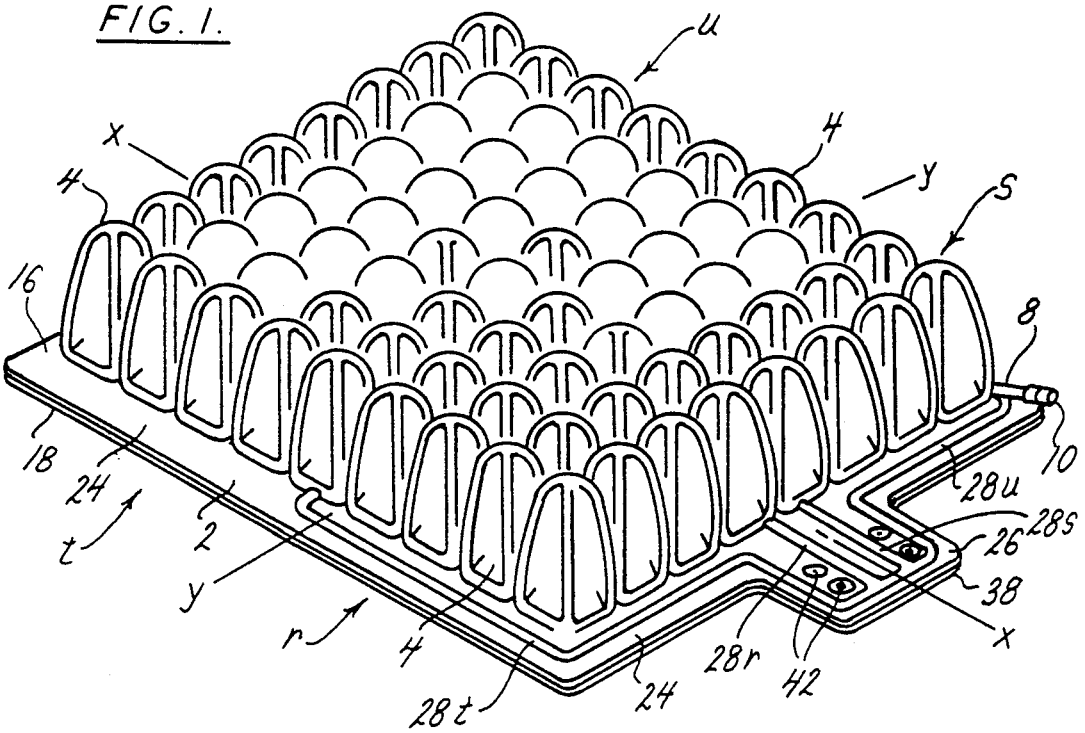
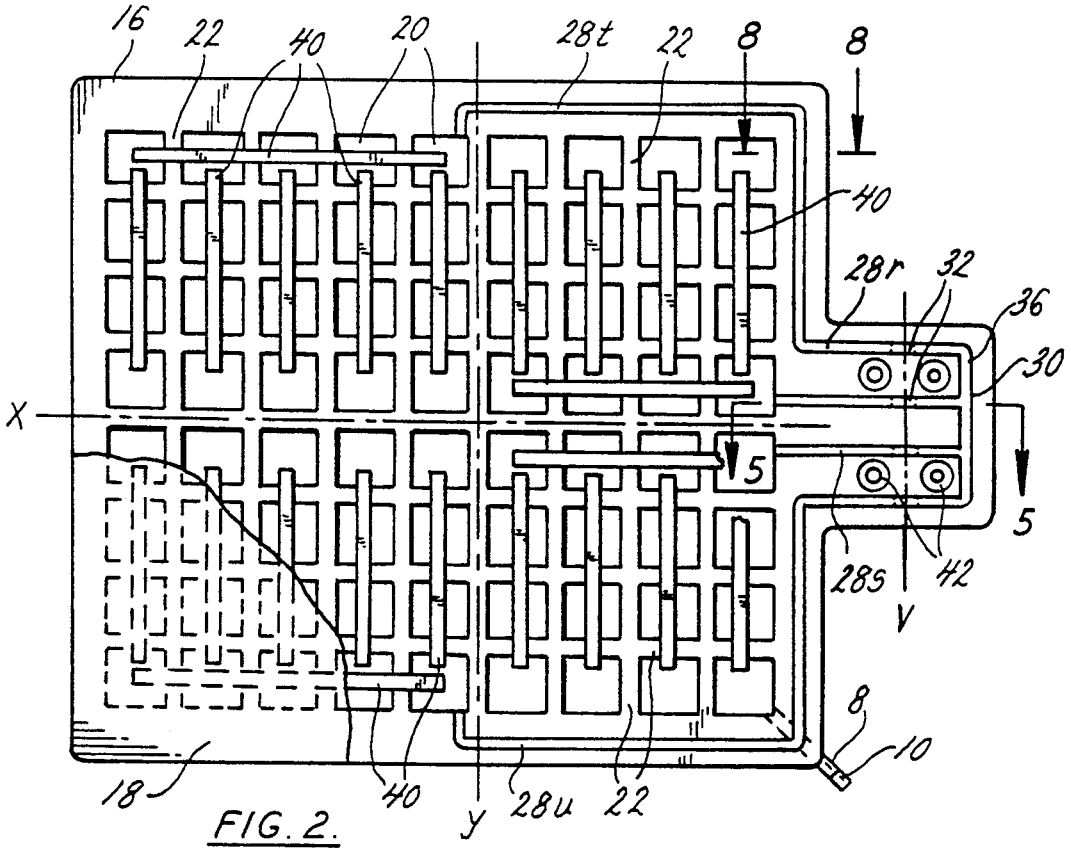
FIG. 2.

FIG. 9.
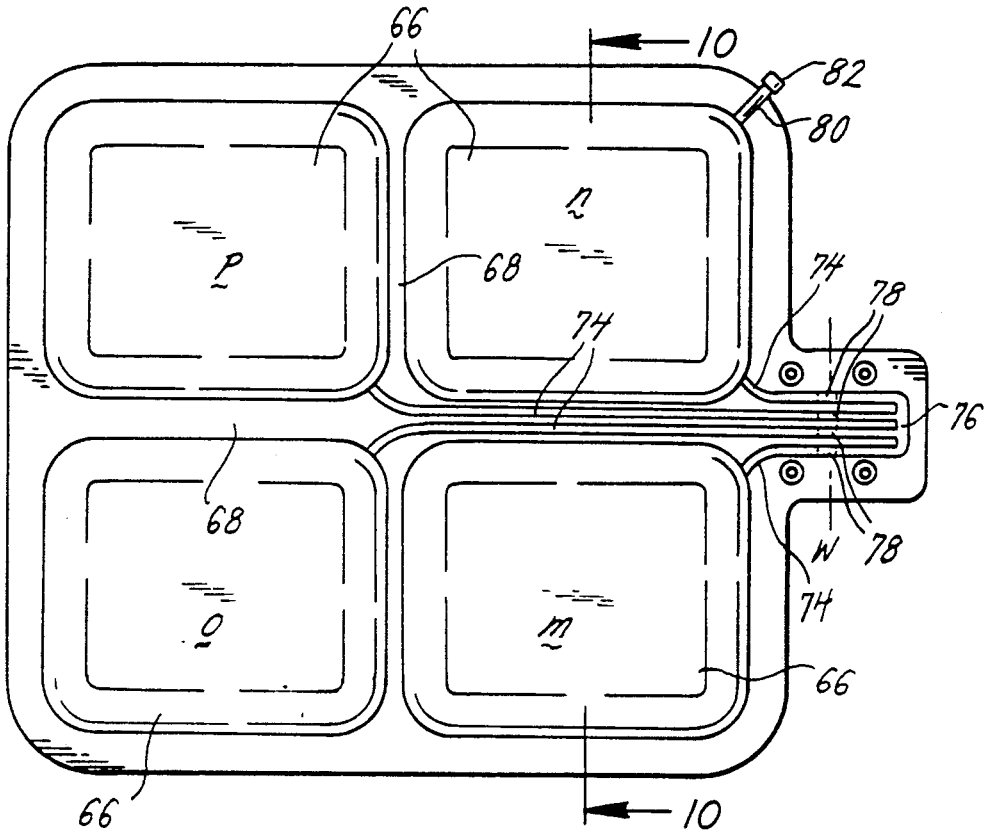
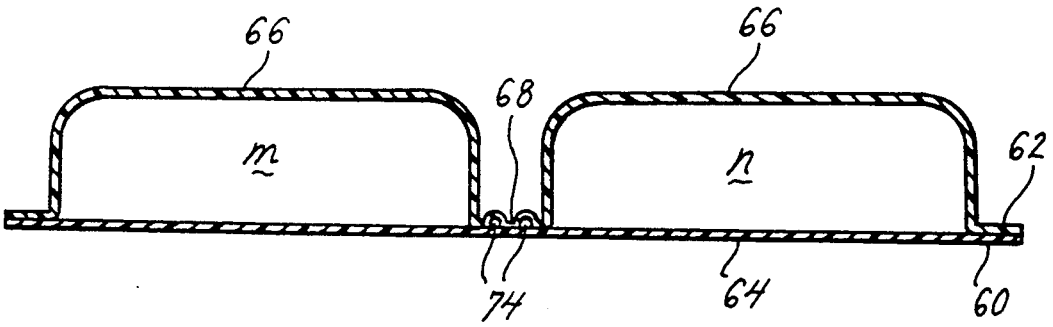
FIG. 10.

ZONED CELLULAR CUSHION WITH FLEXIBLE FLAPS CONTAINING INFLATING MANIFOLD

This application is a continuation-in-part of Ser. No. 607,902, filed Nov. 1, 1990 and now abandoned.

BACKGROUND OF THE INVENTION

This invention relates in general to inflatable cushions, and more particularly to inflatable cushion having normally isolated zones and a valve for placing its normally isolated zones in communication.

Those individuals who are confined to wheelchairs run the risk of tissue breakdown and the development of pressure sores, which are extremely dangerous and difficult to cure. Typically much of the individual's weight concentrates in the regions of the ischia, that is at the bony prominences of the buttocks, and unless frequent movement occurs, the flow of blood to the skin tissue in these regions decreases to the point that the tissue breaks down. Cushions which are especially designed for wheelchairs exist for reducing the concentration of weight in the region of the ischia, and these cushions generally seek to distribute the user's weight more uniformly over a larger area of the buttocks.

Perhaps cellular cushions provide the most uniform distribution of weight and thus provide the greatest protection from the occurrence of pressure sores. These cushions have an array of closely spaced air cells which project upwardly from a common base. Within the base the air cells communicate with each other, and thus all exist at the same internal pressure. Hence, each air cell exerts essentially the same restoring force against the buttocks, irrespective of the extent to which it is deflected. U.S. Pat. No. 4,541,136 shows a cellular cushion currently manufactured and sold by ROHO, Inc., of Belleville, Ill., for use on wheelchairs.

In a sense the typical cellular cushion provides a highly displaceable surface which tends to float the user. While this reduces the incidence of pressure sores, it detracts from the stability one usually associates with a seating surface. Most of those confined to wheelchairs have little trouble adjusting to the decrease in stability, but for those who have skeletal deformities, particularly in the region of the pelvis and thighs, and for those who lack adequate strength in their muscles, lesser stability can be a source of anxiety. A variation of the ROHO cellular cushion addresses this problem with totally isolated zones and also cells of varying height. By varying the pressure between zones, one can accommodate for skeletal deformities while still maintaining satisfactory protection against pressure sores. U.S. Pat. No. 4,698,864 shows a zoned cellular cushion with cells of varying height.

Typically, a zoned cellular cushion has a separate filling stem and valve for each of its zones. The user simply opens the valve of each stem and introduces air into the zone for that stem, usually with a hand pump, and then releases the air from the zones until the desired posture is achieved. In a more sophisticated arrangement, a hose kit connects a single pump to a manifold which in turn is connected to the several valves through separate hoses. These hoses are fitted with separate hose clamps so that the air from the pump may be directed to the cells of the individual zones independently, and likewise the air can be released from them independently, all by manipulating the clamps. The hoses of the hose kit lie externally of the cushion and may become entangled in components of a wheelchair. Furthermore, by reason of their remote location, the hose clamps are difficult to manipulate.

Even more traditional inflatable cushions derive advantages from zoning, that is from being divided into zones or compartments which can be isolated from each other to accommodate skeletal deformities.

The present invention resides in a zoned inflatable cushion and in a valve that forms part of the cushion and facilitates the distribution of air within the cushion, particularly between the zones of the cushion.

DESCRIPTION OF THE DRAWINGS

In the accompanying drawings which form part of the specification and wherein like numerals and letters refer to like parts wherever they occur:

FIG. 1 is a perspective view of a zoned cellular cushion provided with a flap valve, all constructed in accordance with and embodying the present invention, the flap valve being in its extended or open configuration;

FIG. 2 is a bottom plan view of the cellular cushion with a major portion of the bottom layer for the base broken away to illustrate openings at the bottoms of the cells;

FIG. 9 is a plan view of a modified cushion provided with a flap valve;

FIG. 10 is a sectional view taken along line 10—10 of FIG. 9;

DETAILED DESCRIPTION

Figure 3:
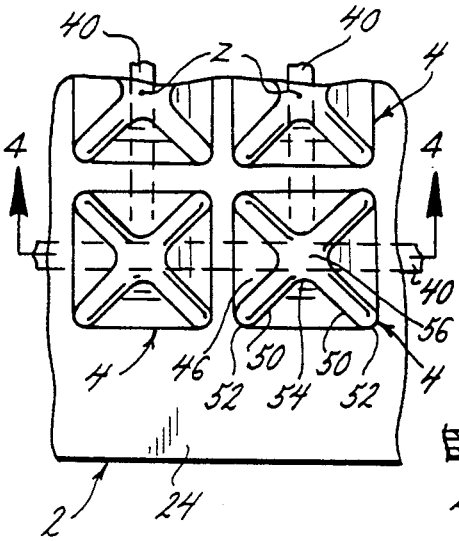
FIG. 3 is a fragmentary top plan view showing several of the cells deflated.

Referring now to the drawings (FIG. 1), A designates a cellular cushion which is highly flexible and is designed for use on an underlying supporting surface, such as, the seat of a wheelchair or the seat of a conventional chair. Being cellular, the cushion A distributes the weight of its occupant generally uniformly over the entire area of the buttocks and thereby dissipates the pressures resulting from the supported weight at the ischia, that is, at the bony prominences of the buttocks. It further has the capacity to position and stabilize the user.

The cushion A includes (FIG. 1) a base 2 and air cells 4 which project upwardly from the base 2. Both the base 2 and the air cells 4 are preferably molded or otherwise formed from highly flexible neoprene. The base 2 is rectangular and the cells 4 are arranged on it in longitudinal rows and transverse rows, with each cell 4 occupying both a longitudinal row and a transverse row. The cells 4 are further arranged in zones, typically, four zones r, s, t, and u. The zones r and s lie side by side at the front of the cushion A, whereas the zones t and u exist side by side at the rear of the cushion A. The right zones r and t are separated from the left zones s and u along a longitudinal axis x, whereas the front zones r and s are separated from the rear zones t and u along a transverse axis y. More or less zones and differing arrangements of those zones may be employed.

Within the base 2, the cells 4 of the zone r communicate with each other, so that all exist at the same internal pressure irrespective of how far they are depressed. The same holds true with regard to the cells 4 of the zone s, the cells 4 of the zone t, and the cells 4 of the zone u. However, the cells 4 of the zone r normally do not communicate with the cells 4 of the zones s, t and u, or in other words the cells 4 of the zone r are normally isolated from the cells of the remaining zones s, t and u. Likewise the cells 4 of the zone s are normally isolated, as are the cells of the zones t and u. Thus, the cells 4 of each zone r, s, t and u collectively enclose a separate compartment.

Figure 5:
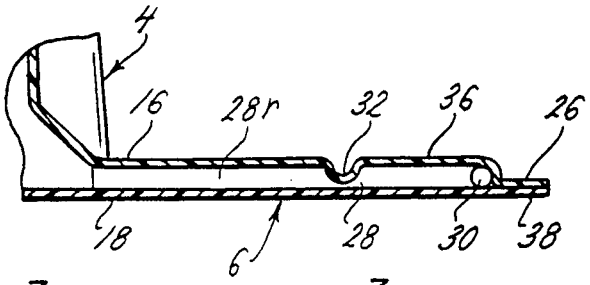
FIG. 5 is a sectional view of the extended flap valve taken along line 5—5, FIG. 2.

Along its front, the base 2 is extended to form a flap-type valve 6 (FIG. 1). When folded over upon itself (FIGS. 6 & 7), the valve 6 isolates the cells 4 of the several zones r, s, t and u. But when opened (FIGS. 1 & 5), it interconnects the zones r, s, t and u, so that the interiors of all of the cells 4 are in communication, and all therefore will exist at the same internal pressure. In addition, one of the cells 4, preferably a cell 4 at one of the front corners of the base 2, has a filling stem 8 (FIG. 1) fitted with valve 10 that is opened and closed simply by turning its end. The stem 8 and valve 10 enable air to be pumped into the cells 4 of the zone in which it is located, and when the flap valve 6 is open, the air inflates the cells 4 of all of the zones r, s, t and u.

The base 2 has an upper layer 16 and a bottom layer 18. The cells 4 rise out of the upper layer 16 and indeed are formed integral with it. As a consequence, the upper layer 16 is interrupted where the hollow interiors of the cells 4 open downwardly, the interiors forming square openings 20 (FIG. 2) which are arranged in the longitudinal and transverse rows. Indeed, the upper layer 16 within the array of air cells 4 exists simply as narrow connecting webs 22 which serve to hold the cells 4 together in the orderly pattern of longitudinal and transverse rows. The upper layer 16 also projects beyond the array of cells 4 and webs 22 in the form of peripheral section 24, which extends around the entire cushion A, and thus exists along each of the four sides of the base 2. Along the front of the peripheral section 24, the upper layer 16 of the base 2 has an outwardly directed tab 26 which is generally centered between the sides of the cushion A. The tab 26 serves as part of the flap valve 6.

The tab 26 contains four channels 28*r*, 28*s*, 28*t* and 28*u* (FIG. 2) which within the tab 26 lie close to and parallel to each other, forming slight ridges on the upwardly presented surface of the upper layer 16. The innermost channels 28*r* and 28*s* lead to and open into the zones r and s, respectively, each actually opening into the interior of a single cell 4 for its respective zone. The outer channel 28*t* extends from the tab 26 into the front of the peripheral section 24 where it turns parallel to the transverse axis y. At the right side of the peripheral section 24, the channel 28*t* turns rearwardly and extends parallel to the longitudinal axis x until it comes to the zone t where it turns inwardly a short distance and opens into the first cell 4 of the zone t. The outer channel 28*u* likewise extends from the tab 26 into the peripheral section 24 and there turns laterally parallel to the transverse axis y. At the left side of the cushion 24, the channel 28*u* turns rearwardly parallel to the longitudinal axis x. It extends rearwardly through the peripheral section 24 to the zone u. There, the channel 28*u* turns inwardly and opens into the first cell 4 of the zone u. Thus, each channel 28 leads to a cell 4 of a different zone.

Within the tab 26 the four channels 28 are connected by a cross channel 30 that lies parallel to the transverse rows b. Indeed, the cross channel 30 lies at the very ends of the four channels 28, so that the channels 28 may communicate through the cross channel 30. Within the tab 26 each channel 28 contains a restriction 32 which is offset from the cross channel 30 by perhaps $\frac{1}{2}$ to $\frac{3}{4}$ inches and on the upper surface of the upper layer 16 appears as an indentation. The cross channel 30 and the portions of the four channels 28 located beyond the restrictions 32 form a manifold 36.

The lower layer 18 of the base 2 lies beneath the upper layer 16 with its margins in registration with the margins of the upper layer 16. As such, it has a tab 38 which underlies the tab 26 of the upper layer 16. In contrast to the upper layer 16, the lower layer 18 is a true sheet, that is, it is continuous throughout and without any channels. It simply closes the bottoms of the air cells 4 and the channels 28 that rise from the upper layer 16. Actually, the lower layer 18 is attached to the upper layer 16 with a rubber cement to form a firm bond between the two layers 16 and 18.

More specifically, the peripheral section 24 of the upper layer 16 is bonded to the lower layer 18 except at the channels 28. This enables air to pass through the peripheral sections 24, but only within the channels 28. The tabs 26 and 38 of the two sections 16 and 18 are likewise bonded together, except in the region of the channels 28 and 30 and at the restrictions 32 near the ends of the channels 28. The tabs 26 and 28 together with the channels 28 and 30 form the flap valve 6.

Along the webs 22 which lie between the front zones r and s and the rear zones t and u, the upper and lower layers 16 and 18 are bonded together without interruption. Likewise, along the webs 22 which separate the right zones r and t from the left zones s and u, the layers 16 and 18 are bonded without interruption. Thus, the cells 4 of the four zones r, s, t, and u are isolated at least along the webs 22 that lie along the axes x and y, and those webs 22 of course lie within the array of air cells 4.

However, within each zone r, s, t, and u, flexible strips 40 of rubber or polymer extend along the transverse rows of cells 4 within that zone. Moreover, along at least one of the longitudinal rows of cells 4 within each zone, another strip 40 extends, and this strip 40 crosses either under or over the transverse strips 40. The strips 40 are considerably narrower then the square openings 20 of the cells 4, and they have the effect of establishing separations in the webs 22 where they cross such webs. Otherwise, these webs 22 are bonded to the lower layer 18, just as are the webs 22 which separate the zones r, s, t and u. In this regard, the webs 22 on their downwardly presented surfaces are completely covered with rubber cement, as is the lower layer 18, on its upper surface, but the strips 40 are not. Hence, they do not adhere to the upper or lower layers 16, 18 and leave gaps which permit air to flow between adjacent cells 4 of a zone r, s, t or u. To insure separation, the strips 40 may be coated with powdered talc.

Figure 6:
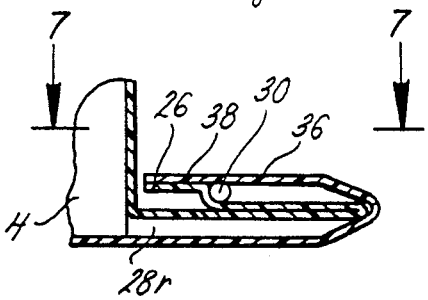
FIG. 6 is a sectional view similar to FIG. 5, but showing the flap valve in its folded or closed condition wherein it isolates the zones of the cushion.
Figure 7:
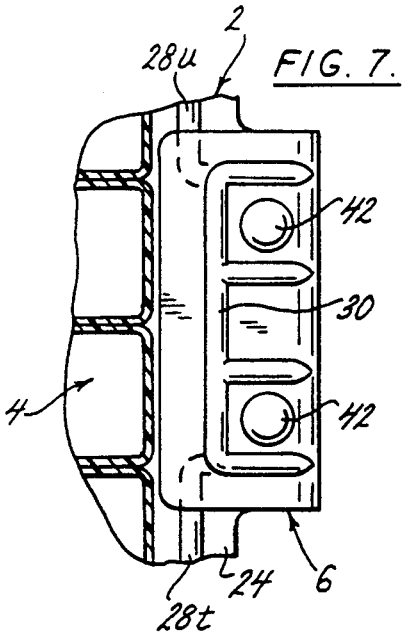
FIG. 7 is a top plan view taken along line 7—7 of FIG. 6 and showing the flap in its folded condition.
Figure 8:
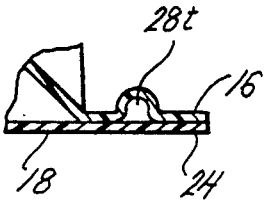
FIG. 8 is a sectional view taken along line 8—8, FIG. 2.

The tabs 26 and 38 fold easily at the transversely aligned restrictions 32, (FIG. 5), and indeed, the indentations produced by the restrictions 32 form a fold line v (FIG. 2) through the flap valve 6. When the outer portion of the flap valve 6 projects laterally from the inner portion, the flap valve 6 is open and air will flow through the restrictions 32. This places the four channels 28 in communication through the cross channel 30, and enables air to flow between the cells 4 of the four zones r, s, t and u. But when the flap valve 6 is folded at the restrictions 32, the fold in the upper layer 16 pinches the channels 28 at the restrictions 32, effectively blocking the channels 28 so that no air can flow in them to or from the cross channel 30 (FIGS. 6 & 7). The flap valve 6 is provided with button-type snaps 42, there being one set of snaps 42 in the outer portion and another set in the inner portion. When the valve 6 is folded, the outer snaps 42 align with the inner snaps 42 and upon being pressed together, will interlock, thus retaining the valve 6 in the folded condition. Other types of fastening devices, such as, Velcro fastening material, may be used in lieu of the snaps 42.

Figure 4:
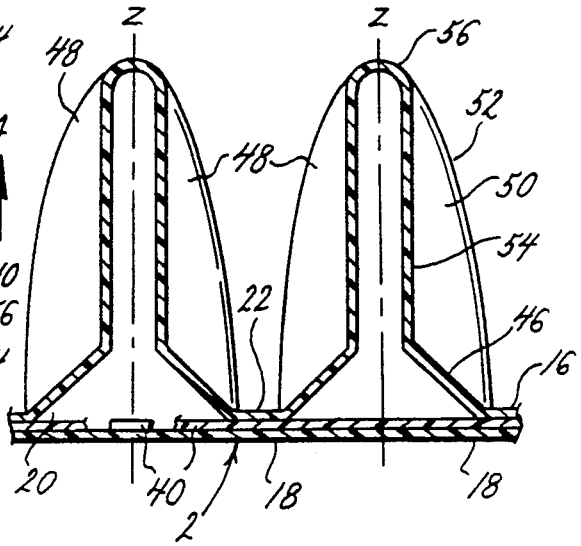
FIG. 4 is a sectional view taken along line 4—4 of FIG. 3 and showing the cells deflated.

The air cells 4 project upwardly from the upper layer 16 of the base 2 and indeed are formed integral with that layer from the neoprene. Each air cell 4 is symmetrical about a center axis z (FIGS. 3 & 4) that is perpendicular to the base 2 and in its deflated configuration, that is the configuration in which is it formed, includes a pedestal 46 and four projections or fins 48 which extend upwardly from the pedestal 46, the fins 48 being arranged at 90° intervals around the axis z. The pedestal 46 is pyramidal and as such has four sloping side walls. Where it merges into the upper layer 16 of the base 2 it is square and indeed defines a square opening 20 in the upper layer 16. The fins 48 extend out to the corners of the pyramidal pedestal 46 and each fin 48 has spaced apart side walls 50 which are parallel. Along the outside of the fin 48, these walls 50 are connected by a convex edge wall 52. The side walls 50 of adjacent fins 48 merge at concave connecting walls 54. Thus, each air cell 4 has a depression opening out of each of its four sides, there being a different depression above each of the four inclined walls that comprise the pedestal 46. The connecting walls 54 extend upwardly from the upper end of the pedestal 46 and are straight throughout most of their length. The convex edge walls 52 on the other hand extend upwardly from the corners of the pedestal 46 and thus originate at the upper layer 16. For much of their length the convex edge walls 52 are generally straight, but near their upper ends they, in contrast to the concave walls 54, curve inwardly toward the axis z. At the upper end of the air cell 4, the convex edge walls 52, the side walls 50 and the connecting walls 54 all merge into a dome 56 which is the top of the air cell 4 (FIGS. 3 & 4).

The cells 4 and the upper layer 16 of the base 2 may be formed over a mandrel in a dipping operation. See U.S. Pat. No. 4,541,136.

When an air cell 4 is inflated by introducing air from the base 2 into the square opening 20 at its bottom, the side walls 50 of adjacent fins 48 and the concave connecting walls 54 between such sidewalls invert, bringing the inclined walls of the pedestal 46 out with them (FIG. 7). The cell 4 in cross section assumes a generally square configuration which is larger than its square opening 20 in the upper layer 16 of the base 2. However, the dome 56 becomes less pronounced. When all of the cells 4 are inflated together, which is normally the case, the sides of adjacent cells 4 contact each other and the domes 56 form a generally continuous, but highly displaceable, supporting surface.

In order to prepare the cushion A for the user, the flap valve 6 is opened, that is to say its snaps 42 are detached and its outer portion is folded outwardly with respect to its inner portion (FIG. 1). This opens the restrictions 32 enough (FIG. 5) to place the interiors of the cells 4 for the four zones r, s, t and u in communication through the manifold 36 in the outer portion of the valve 6. Also, the filling valve 10 in the valve stem 8 is opened and air is pumped into it with a pump which connects to the valve 10. The air initially flows into the cells 4 of the zone s, but since the cells 4 of the remaining zones r, t and u are in communication with the cells 4 of the zone s through the manifold 36 of the open flap valve 6, all of the cells 4 are inflated. The cells 4 reach a state of equilibrium in a short time. Enough air is pumped into the cushion A to exceed the requirements for supporting the user. The valve 10 is then closed and the pump removed.

Next the overinflated cushion A is placed on the supporting surface upon which it is to rest when supporting the user, and that could be a wheelchair seat or the seat of a traditional chair. The user then sits upon the cushion A in the location he expects to assume and slowly releases air from the filling valve 10 to immerse the user. As the air is released, the user's buttocks sink deeper and deeper into the array of air cells 4, and they tend to envelope and assume the contour of the buttocks. Enough air is released to bring the region of the ischia to within about ½ inch of the base 2. Of course, as the air flows out of the cushion A, all of the cells 4 remain at essentially the same internal pressure, because they are all interconnected through the open flap valve 6. When the user achieves the desired immersion, the filling valve 10 is closed.

While immersed in the cells 4 of the cushion A, the user moves or is moved by others to the posture desired to be maintained for an extended period, and this causes a redistribution of air amongst the cells 4 of the several zones r, s, t and u. In time, the cells 4 of the several zones r, s, t and u reach equilibrium, that is to say the flow between the zones r, s, t and u ceases. At this time, the flap valve 6 is folded over upon itself and the snaps 42 are engaged, thus holding the valve 6 in its folded or closed configuration (FIGS. 6 & 7). The fold line v, which passes through the transversely aligned restrictions 32, blocks the channels 28 at the restrictions 32 and prevents air from flowing between the zones r, s, t and u.

The isolated zones r, s, t and u impart stability to the cushion A, and this serves to maintain the user in the selected posture. Thus, if the user attempts to assume a different posture, he will encounter greater resistance from cells 4 of one of more of the zones r, s, t and u, and they will urge the user back to the initial posture. The capacity to maintain a selected posture or to urge the user to such a posture is particularly useful with users who suffer from spinal deformities and for those whose muscles have atrophied.

In lieu of forming the channels 28 and 30 in the upper layer 16 of the base 2, they may be formed in the lower layer 18 or they may exist in both the upper and lower layers 16 and 18. Also, a cell in each zone r, s, t and u may be fitted with a filling stem 8 and valve 10, so that the cells 4 of the different zones r, s, t and u could be inflated or deflated independently of one another, but again the flap valve 6 is used to temporarily establish a state of equilibrium between all of the zones r, s, t and u.

A modified cushion B (FIGS. 9 and 10) also has a rectangular base 60 composed of upper and lower layers 62 and 64, but instead of having cells 4 arranged in zones, it simply has four pads 66 which extend upwardly from the base 60 and occupy separate quadrants of the cushion B. In effect, the pads 66 form four different compartments or zones m, n, o and p in the cushion B. The upper and lower layers 62 and 64 of the base 60 are joined together along webs 68, which separate the pads 66, and also along a peripheral section 70 which circumscribes the cushion B. The two layers 62 and 64 may be cut from vinyl sheet, with the pads 66 derived from the former in a vacuum forming operation. The two sheets are simply welded together to form the base 60. The base 60 along its peripheral section 70 projects outwardly in the form of a flap valve 72 containing a fold line w. In the region of the flap valve 72, the base 60 contains channels 74 which lead from the flap valve 72, where they lie side by side and parallel, to the several pads 66, there being a separate channel 74 for each pad 66. Preferably, the valve 72 is centered with respect to the edge along which it lies and the two outer channels 74 lead to and open into the compartments m and n formed by the two closest pads 66. The two inner channels 74 pass through the web 68 that separates the closest pads 66 and open into the compartments o and p formed by the two farthest pads 66. Within the flap valve 72, the channels 74 cross the fold line w, and beyond open into a cross channel 76. Each channel 74 at the fold line w has a restriction 78 which effectively blocks the channel 74 when the flap valve 70 is folded along the fold line w.

The cushion B is inflated through a filling stem 80 and valve 82 extended from one of its pads 66.

While the cushions A and B are designed for seats, they may be expanded in area and perhaps configured differently in the arrangement of the zones to serve other cushioning purposes, such as that of a mattress. Also, the cushions A and B may be supplied as totally sealed systems, that is without any filling stem 8 or valve 10. While air is the preferred fluid for inflating the cushions A and B, other gases and other fluids, even liquids, may be used to inflate as well.

MODIFICATION

Figure 11:
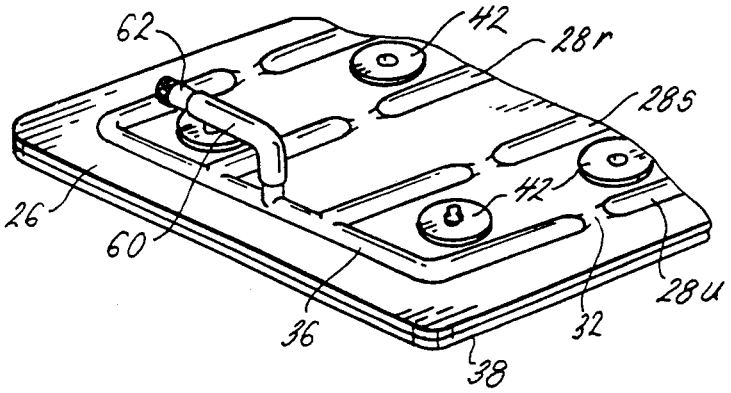
FIG. 11 is a fragmentary perspective view of a modification of the flap valve showing a fill valve on the manifold.
Figure 12:
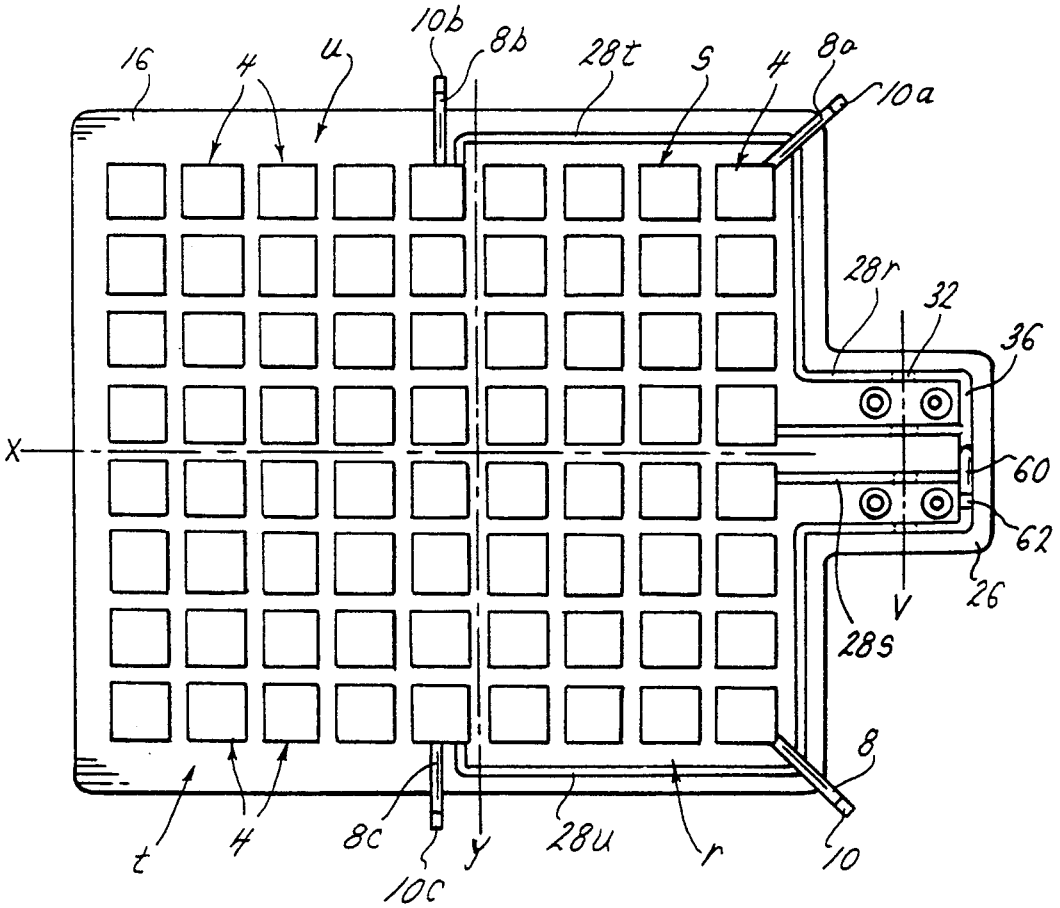
FIG. 12 is a top plan view showing the deflated cells schematically, and showing a modification of the invention having fill valves in the manifold and in each zone.

FIGS. 11 and 12 show a modification of this invention which makes it easier to adjust each of the individual zones. In this form of the invention, a separate fill stem 8, 8*a*, 8*b*, and 8*c* is provided for each of the zones r, s, u and t, respectively. In addition, a separate fill stem 60 is provided on the manifold 36. Each of the fill stems 8, 8*a*, 8*b*, 8*c* and 60 have a fill valve 10, 10*a*, 10*b*, 10*c* and 62 on the end thereof so that air can be introduced and let out of the cells and the manifold.

The five fill valves allow for rapid adjustment of any of the zones on an individual basis. These valves also allow each quadrant or zone to be tested individually and rapidly for leaks in the assembly process. The fifth valve 60, 62 allows easy testing of the flap valve 6 and the manifold 36 for leaks during assembly. The flap fill valve 60, 62 also allows the cushion zones to be inflated and adjusted through air entering and leaving the manifold 36.

The manifold flap stem 60 preferably is installed parallel to the manifold 36.

This invention is intended to cover all changes and modifications of the example of the invention herein chosen for purposes of the disclosure which do not constitute departures from the spirit and scope of the invention.

What is claimed is:

1. A cellular cushion comprising: a flexible non-rigid base; a plurality of flexible and hollow fluid-containing cells attached to and projecting away from the base, the cells being organized into zones, with the interiors of the cells for each zone within the region of the zone being in communication through the base, but not with the air cells of the other zones; a manifold carried by the flexible base at one edge thereof and extending outwardly from the base edge, the manifold being substantially flexible and non-rigid throughout its entire area; a separate channel for each zone, with each channel extending between at least one cell of its zone and the manifold, whereby the cells of the different zones communicate only through the manifold; means for blocking the channels so that the cells of the different zones do not communicate; and independent means for introducing air into the cells of at least one of the zones without going through the manifold.

2. The cushion of claim 1 wherein the manifold and channels are positioned in the flexible non-rigid flap at the edge of the base and the channels extend from the manifold to the base, and wherein the channels are restricted to less than one-half of their height in a line parallel to the base edge and on the flap to define a fold line whereby the flap can be folded on itself to block the channels, and fastening means to retain the flaps in folded channel blocking position.

3. The cushion of claim 2 wherein the fastening means are snap fasteners positioned in the flap adjacent to the channels and between the channels.

4. The cushion of claim 1 wherein the flexible flap extends over substantially less than one-half the length of the base edge.

5. The cushion of claim 1 including independent means for introducing air into each of the zones without going through the manifold.

6. A cellular cushion comprising: a first base layer formed from a flexible material; cells formed from a flexible material and being attached to and extending away from the first base layer where they are arranged in an array, the cells being set inwardly from the periphery of the first base layer so that a peripheral section of the first layer extends around the array of cells, the cells also being spaced apart at their bottoms, so that within the array of cells, the first base layer has webs which connect adjacent cells; a second base layer formed from a flexible material and attached to the peripheral section and to the webs of the first base layer to close the bottoms of the cells, the attachment being such that it organizes the cells into zones which are isolated from each other within the array of cells, the second layer being detached from the first layer in selected areas within each zone to enable the cells of each zone to communicate with each other, but not with the cells of adjacent zones; channels within at least one of the layers leading from a selected location in the peripheral section to the zones, there being a separate channel for each zone; and valve means at the selected location for connecting the channels when said valve means is open so that the air cells of the zones are in communication and for blocking the channels and isolating them from one another when the valve means is closed so that the air cells of the different zones are isolated; the valve means including a manifold that leads to and opens into all of the channels when the valve means is open, but is isolated from the channels when the valve means is closed; filling stems connected to a cell of each of the zones which are independent of the manifold and the air channels and an additional separate filling stem connected to the manifold, and filling valves in the stems for admitting air to the cells and to the manifold when the filling valves are open; each of the cells being capable of being filled and depleted of air independent of the others when the manifold valve means is closed.

7. The cushion of claim 6 wherein the manifold is in a flap which is flexible throughout its width and which projects outwardly from the peripheral section of the first base layer along an edge thereof.

8. The cushion of claim 7 wherein the flap extends along the edge substantially less than one-half of the length of the edge.

9. The cushion of claim 7 wherein the channels extend into the flap from the base and are restricted to less than one-half of their height in a line parallel to the base edge and on the flap to define a fold line whereby the flap can be folded on itself to block the channels, and fastening means to retain the flaps in folded channel blocking position.

10. The cushion of claim 9 wherein the fastening means are snap fasteners positioned in the flap adjacent to the channels and between the channels.

11. A cellular cushion comprising: a flexible non-rigid base; a plurality of flexible and hollow fluid-containing cells attached to and projecting away from the base, the cells being organized into zones, with the interiors of the cells for each zone within the region of the zone being in communication through the base, but not with the cells of the other zones; a manifold carried by the flexible base at one edge thereof and extending outwardly from the base edge; a separate channel for each zone, with each channel extending between at least one cell of its zone and the manifold, whereby the cells of the different zones communicate only through the manifold; and valve means for connecting the channels through the manifold when said valve means is open so that the air cells of the zones are in communication and for blocking the channels and isolating them from one another when the valve means is closed so that the air cells of the different zones are isolated; filling stems connected to a cell of each of the zones which are independent of the manifold and the air channels and an additional separate filling stem connected to the manifold and filling valves in the stems for admitting air to the cells and to the manifold when the filling valves are open; each of the cells being capable of being filled and depleted of air independently of the others when the manifold valve means is closed.

12. The cushion of claim 11 wherein the base has a peripheral edge and channels communicating the zones with the manifold are positioned in said peripheral edge.

13. An inflatable cushion comprising: a flexible non-rigid base; a plurality of separate flexible and hollow fluid-containing compartments attached to and projecting away from the base, a manifold carried by the flexible base at one edge thereof and extending outwardly from the base edge, the manifold being substantially flexible and non-rigid throughout its entire area; channels located within the base such that they connect the compartments to the manifold, there being a separate channel for each compartment whereby the compartments communicate only through the manifold,; means for blocking the channels so that the compartments do not communicate; and independent means for introducing air into each of the compartments without going through the manifold.

14. The cushion of claim 13 wherein the flexible flap extends over substantially less than one-half the length of the base edge and the channels are positioned in the base adjacent to the centering thereof and aligned with the flexible flap.

15. The cushion of claim 13 wherein the channels extend into the flap from the base and are restricted to less than one-half of their height in a line parallel to the base edge and on the flap to define a fold line whereby the flap can be folded on itself to block the channels, and fastening means to retain the flaps in folded channel blocking position.

16. A cellular cushion comprising: a flexible non-rigid base; a plurality of flexible and hollow fluid-containing cells attached to and projecting away from the base, the cells being organized into zones, with the interiors of the cells for each zone within the region of the zone being in communication through the base, but not with the air cells of the other zones; a manifold carried by the flexible base at one edge thereof and extending outwardly from the base, the manifold being substantially flexible and non-rigid throughout its entire area; a separate channel for each zone, with each channel extending between at least one cell of its zone and the manifold, whereby the cells of the different zones communicate only through the manifold; means for blocking the channels so that the cells of the different zones do not communicate; independent means for introducing air into the cells of all of the zones without going through the manifold, the manifold and channels being positioned in the flexible non-rigid flap at the edge of the base and the channels extending from the manifold to the base, the channels being restricted to less than one-half of their height in a line parallel to the base edge and on the flap to define a fold line whereby the flap can be folded on itself to block the channels, and fastening means to retain the flaps in folded channel blocking position.

* * * * *